US005584477A

United States Patent [19]

Sakai

[11] Patent Number: 5,584,477

[45] Date of Patent: Dec. 17, 1996

[54] PAPER DELIVERY APPARATUS OF PRINTING MACHINE

[75] Inventor: Toshimitsu Sakai, Tokyo, Japan

[73] Assignee: Riso Kagaku Corporation, Tokyo, Japan

[21] Appl. No.: 439,451

[22] Filed: May 11, 1995

[30] Foreign Application Priority Data

May 16, 1994 [JP] Japan ..... 6-101236

[51] Int. Cl.[6] ..... B65H 43/04

[52] U.S. Cl. ..... 271/198; 271/240; 271/253; 198/626.1; 34/662

[58] Field of Search ..... 271/198, 903, 271/207, 234, 240, 254, 184, 253; 34/662; 198/607, 626.1

[56] References Cited

U.S. PATENT DOCUMENTS

| | | | |
|---|---|---|---|
| 4,050,467 | 9/1977 | Sluis et al. | 198/626.1 |
| 5,113,992 | 5/1992 | Sadamori | 298/607 |
| 5,429,349 | 7/1995 | Supron et al. | 271/184 |

FOREIGN PATENT DOCUMENTS

| | | | |
|---|---|---|---|
| 483969 | 9/1929 | Germany | 198/626.1 |
| 48711 | 11/1987 | Japan | 271/198 |
| 691673 | 5/1953 | United Kingdom | 198/626.1 |

*Primary Examiner*—H. Grant Skaggs
*Attorney, Agent, or Firm*—Kanesaka & Takeuchi

[57] ABSTRACT

A paper delivery apparatus of a printing machine includes a holding device having at least a pair of rotating members fitted, in the vicinity of both side edges of printed sheets, with a paper receiving section for holding the side edges of the printed sheets ejected from the printing machine, a driving device for rotating the rotating member to move downward in succession the printed sheets held on the paper receiving section. A paper stacking section disposed beneath the rotating body for holding the printed sheets which have been released from the paper receiving section; and a space between the paper receiving section for holding one side edge of the printed sheet and the paper receiving section for holding the other side edge of the printed sheet is set narrower at the lower part of the rotating member for discharging the printed sheet than at the upper part of the rotating member for receiving the printed sheet.

8 Claims, 14 Drawing Sheets

FIG. 9-a
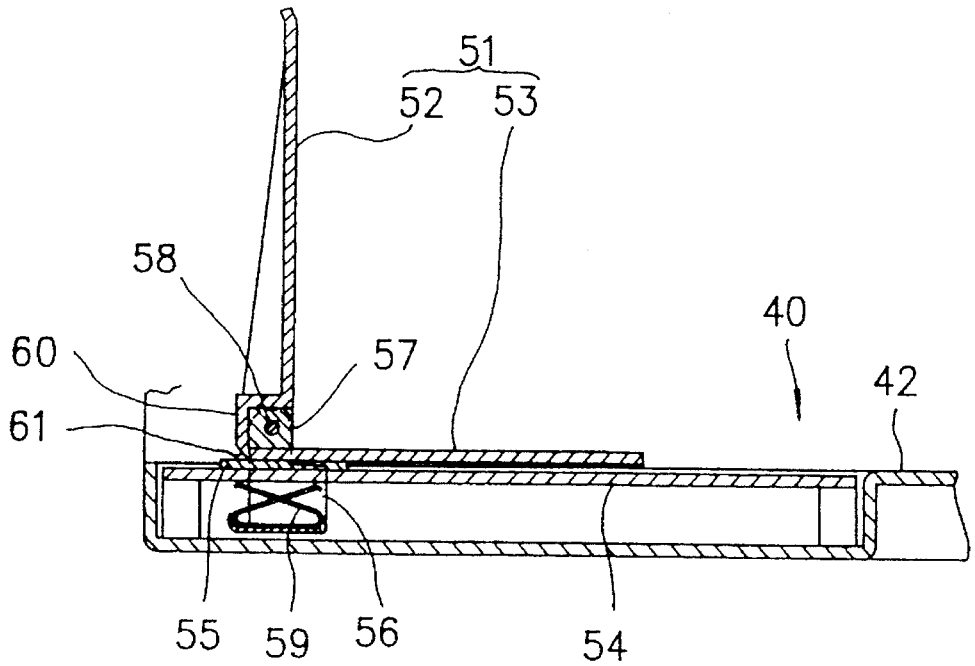
FIG. 9-b
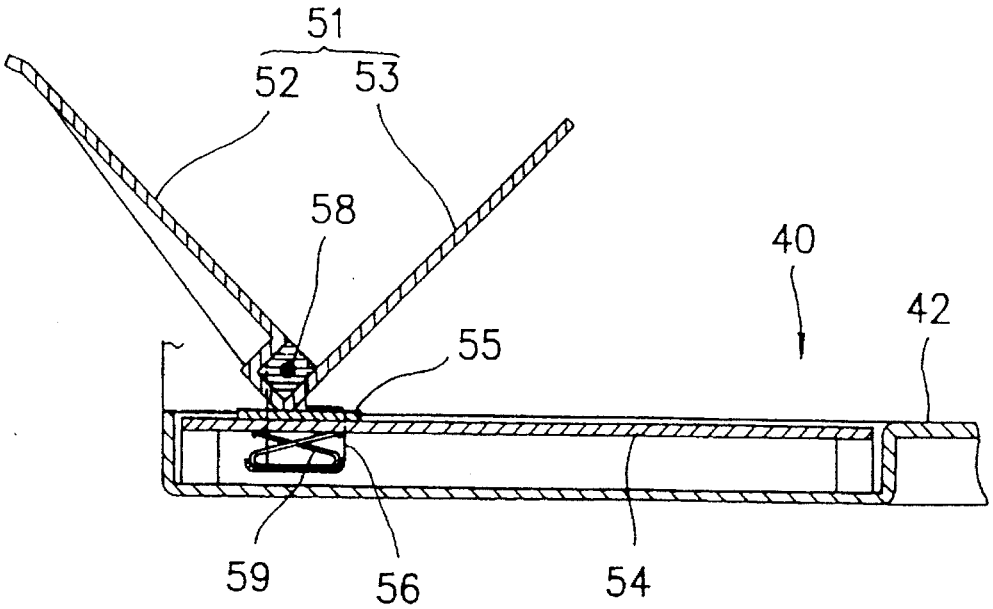

PAPER DELIVERY APPARATUS OF PRINTING MACHINE

BACKGROUND OF THE INVENTION

The present invention relates to a paper delivery apparatus of a printing machine, and more particularly, to a paper delivery apparatus for holding printed sheets being discharged from the printing machine one by one at regular intervals in a vertical direction, carrying the sheets downward for a preset distance to a specific position every time each printed sheet is ejected from the printing machine, and successively dropping it to stack on a receiving tray.

As printed sheets are stacked in succession immediately after printing, there occurs the so-called "setoff" wherein the back side of the following printed sheet will be smudged with ink when laid on the preceding printed sheet. This tendency is remarkable in the case of printing on nonabsorbent papers such as postcards and the like.

The present applicant, therefore, invented an apparatus as shown in FIG. 13. In this drawing, a printed sheet W is discharged from the printing machine along a direction perpendicular to the paper surface illustrated, entering through an entrance route E. Near the entrance route E is provided a holding means 300 for receiving and holding the printed sheets W one by one.

The holding means 300 has at least a pair of belt mechanisms disposed in the vicinity of both side edges of the printed sheet W. Each belt mechanism comprises upper and lower pulleys 301 and 302 and a belt 303 wound around these pulleys. On the belts 303 are provided paper receiving sections 304 for holding both side edges of the printed sheet W, at an equal space in the direction of movement of the belt 303.

In the drawing, the printed sheet W being discharged from the printing machine is supported by the paper receiving sections at the uppermost stage which are ready for receiving the printed sheet W. Every time the printed sheet is ejected from the printing machine, the belt mechanisms of the holding means 300 is driven to move the printed sheet on the paper receiving sections 304 successively downward until the next paper receiving sections 304 come to the uppermost stage receive the following printed sheet. With the rotation of the holding means 300, the paper receiving sections 304 move downward as low as a specific position, and then the printed sheet W supported on the paper receiving sections 304 goes down off the paper receiving sections 304, to be received in a receiving tray 305 located below.

While the printed sheet W is held by the holding means 300, the ink on the paper dries and accordingly no setoff will occur on the printed sheet W stacked in the receiving tray 305.

If the printed sheet W in the receiving tray 305 moves, the printed surface of the printed sheet is rubbed to be smeared. Therefore, the width of the tray 305 has been set to agree with the width of the printed sheet W as much as possible. In the meantime, according to the delivery apparatus previously stated, the spacing between the pair of belts 303, 303 has been set larger than the width of the printed sheet W with the facility of receiving the printed sheet W.

Therefore, there is a positional difference, in the direction of width, of the printed sheet W held by the paper receiving sections 304 of the belts 303. If, therefore, the printed sheet W dropping from the holding means 300 is off the proper position, the side edge of the printed sheet W will touch the upper end of the side wall of the receiving tray 305 as shown in FIG. 13, resulting in improperly stacked printed sheet W in the tray 305.

SUMMARY OF THE INVENTION

In view of the above-described disadvantages, it is an object of the present invention to provide a paper delivery apparatus of a printing machine in which printed sheets of paper supported at regular intervals are carried downward and released downward by means of at least a pair of rotating members on which a plurality of paper receiving sections are arranged in a row, so that the sheets are properly positioned in the direction of width of the printed sheet in a receiving tray.

The paper delivery apparatus of the printing machine according to the first aspect of the present invention has a holding means provided with a pair of rotating members which are disposed near both side edges of the printed sheet for holding the side edges of the printed sheet discharged from the printing machine, a driving means for driving the rotating members to successively move down the printed sheet supported on the paper receiving sections, and a holding section located beneath the rotating members to hold the printed sheet released from the paper receiving sections. A spacing between the paper receiving section for holding one side edge of the printed sheet and the paper receiving section for holding the other side edge of the printed sheet has been set narrower at the lower part of the rotating members at which the printed sheet is discharged than at the upper part of the rotating members at which the printed sheet is received.

In the paper delivery apparatus of the printing machine according to the second aspect of the present invention, the rotating members in the first aspect are belts wound around upper and lower pulleys and the paper receiving section comprises a plurality of paper receiving flaps equally spaced in the direction of movement of the belt.

In the paper delivery apparatus of the printing machine according to the third aspect of the present invention, the lower pulley in the second aspect is larger in diameter than the upper pulley.

In the paper delivery apparatus of the printing machine according to the fourth aspect of the present invention, in which the lower pulley in the second aspect has the same diameter as the upper pulley.

The printed sheet ejected from the printing machine is held by the paper receiving section at the upper parts of the rotating members of the holding means. When the rotating members are driven by the driving means and the printed sheet held by the paper receiving sections moves downward, the spacing of a pair of paper receiving sections holding the printed sheet gradually decreases to thereby correct the position in the direction of width of the printed sheet. At the lower parts of the rotating members of the holding means the printed sheet is released to fall from the paper receiving sections. The position thereof is fixed in the direction of width of the printed sheet. The printed sheet that has dropped is properly received in the holding section below the holding means.

Other features and advantages of the present invention will become apparent from the following description of the present invention, together with the accompanying drawings.

BRIEF DESCRIPTION OF THE DRAWINGS

FIG. 5(*b*) is a view showing primary and secondary holding means in a different embodiment;

FIG. 9*a* and 9*b* are perspective views showing the operation of the paper receiving tray of the paper delivery apparatus;

DETAILED DESCRIPTION OF THE PREFERRED EMBODIMENT

Figure 1:
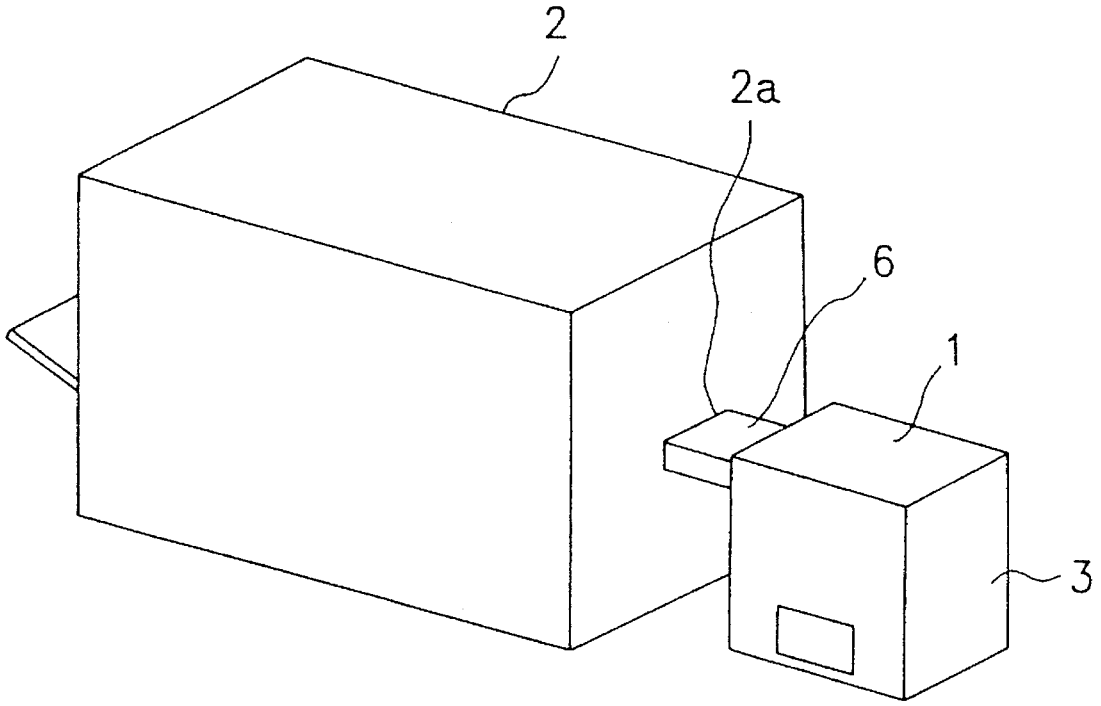
FIG. 1 is a perspective view of an outside appearance of the paper delivery apparatus connected with a printing machine.
Figure 2:
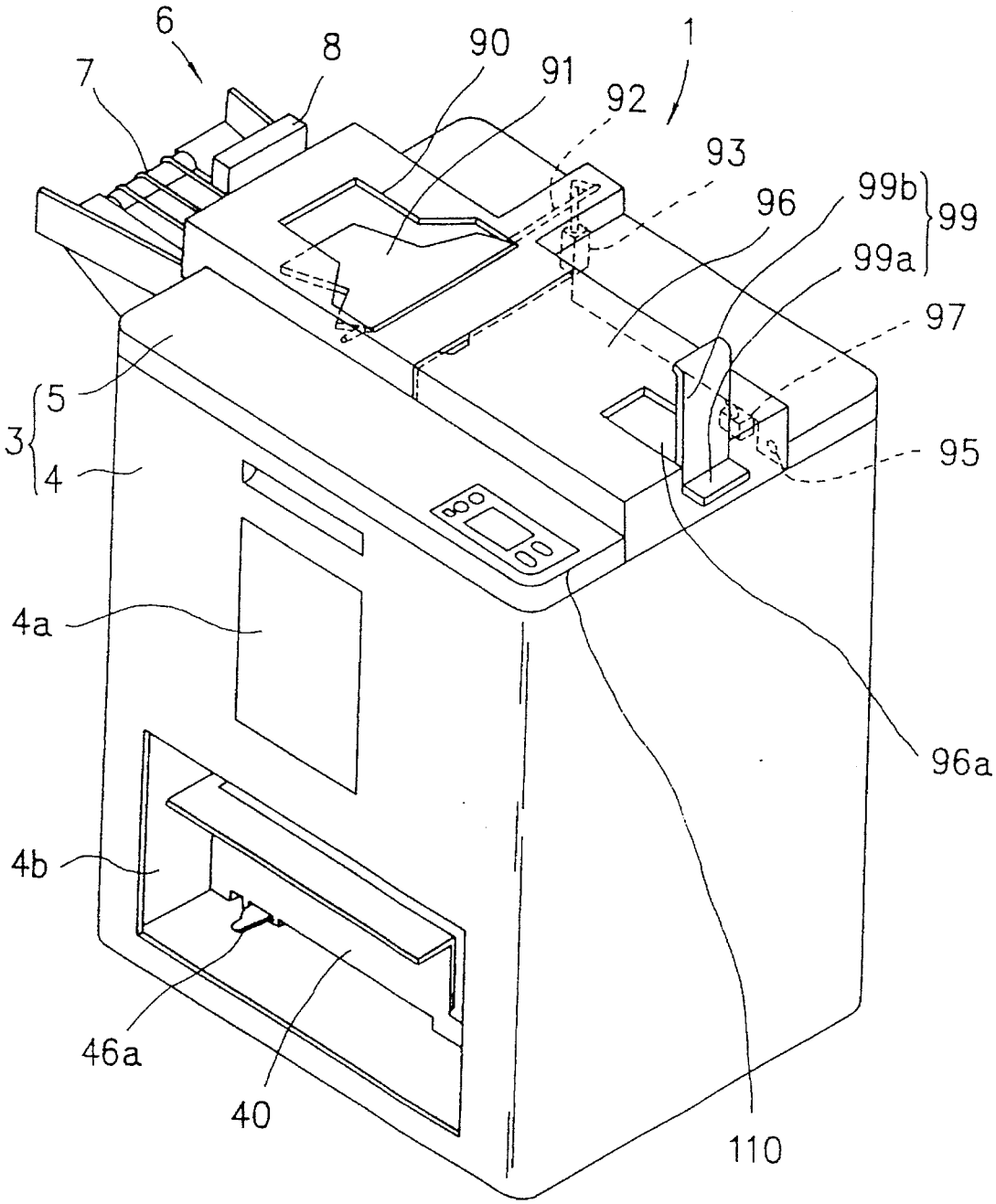
FIG. 2 is a perspective view showing the outside appearance of the paper delivery apparatus.
Figure 3:
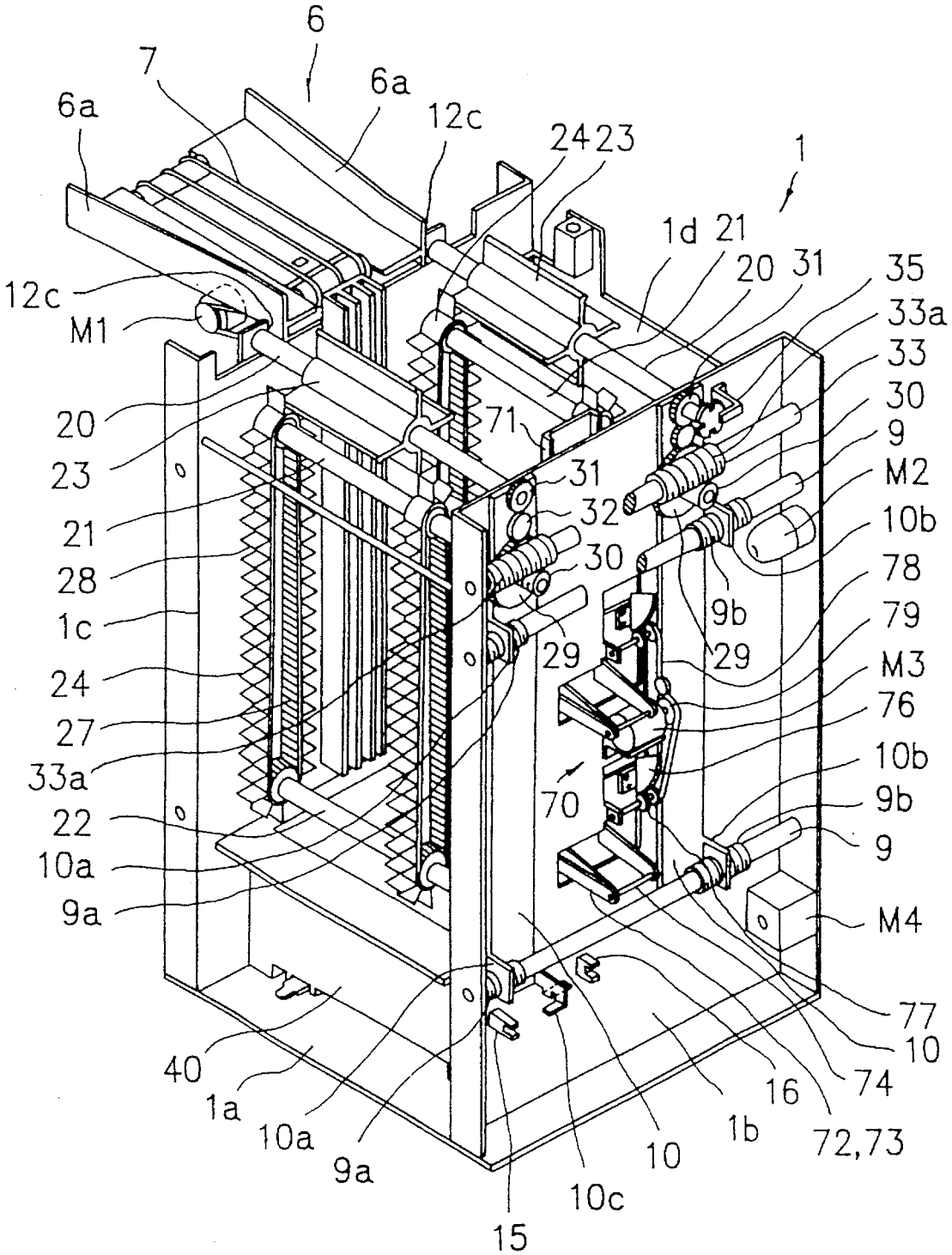
FIG. 3 is a perspective view of an internal mechanism of the paper delivery apparatus.

Hereinafter one preferred embodiment of a paper delivery apparatus 1 according to the present invention will be explained with reference to the accompanying drawings. FIG. 1 is a perspective view showing the outside appearance of the paper delivery apparatus 1 connected with a printing machine 2; FIG. 2 is a perspective view showing the outside appearance of the paper delivery apparatus 1; FIG. 3 is a perspective view showing the internal mechanism of the paper delivery apparatus 1; and FIG. 4 is a perspective view showing the internal mechanism, partly omitted, of the paper delivery apparatus 1 as viewed in the direction opposite to FIG. 3.

Figure 4:
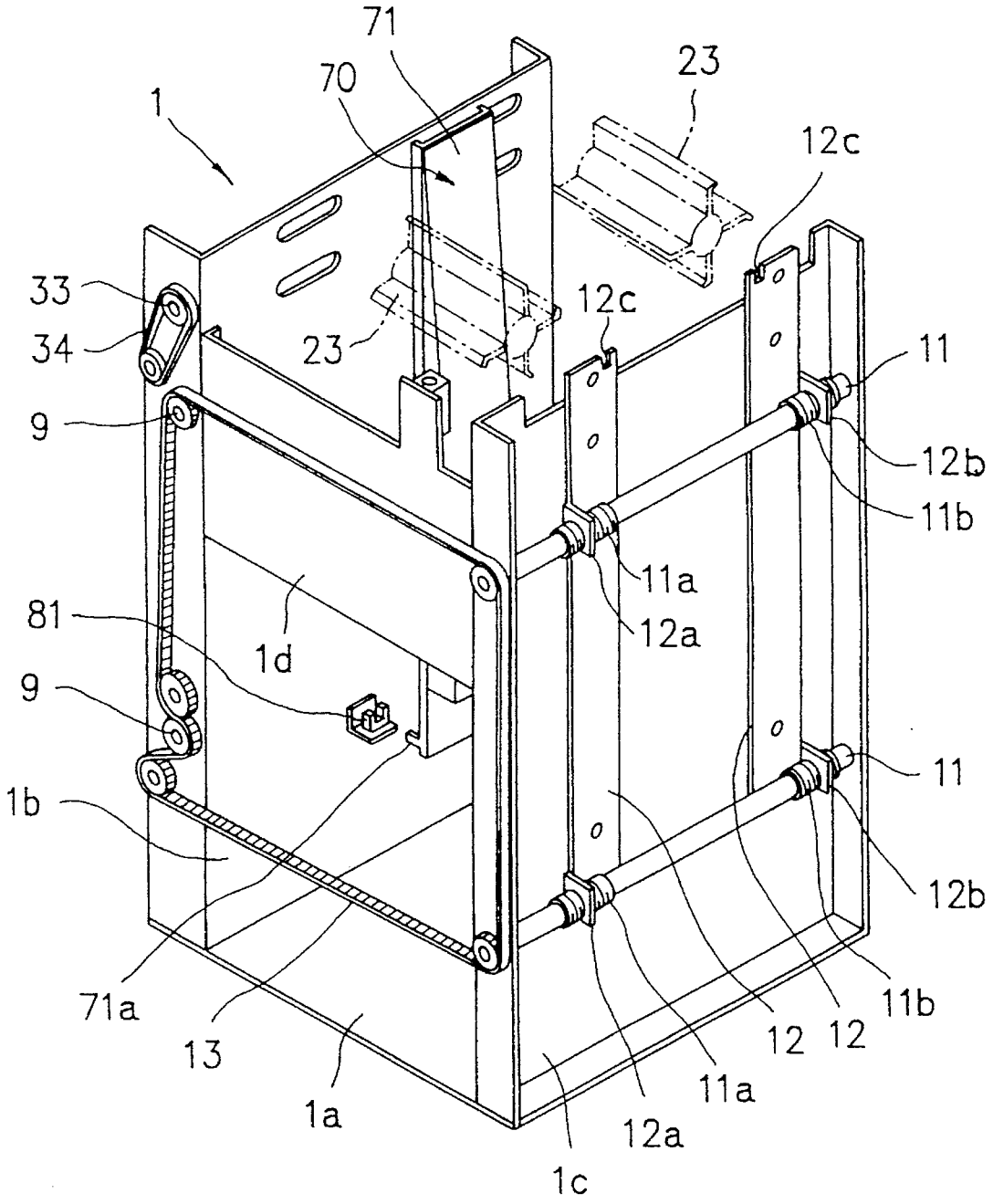
FIG. 4 is a perspective view of the internal mechanism, partly omitted, of the paper delivery apparatus viewed in the direction opposite to FIG. 3.

The paper delivery apparatus 1 is of such a constitution that the internal mechanism shown in FIGS. 3 and 4 is enclosed with a casing 3 as shown in FIG. 2. The casing 3 comprises a box-type wall 4 and a cover section 5 which covers the upper side of the wall 4. In a part of the wall 4 is provided a transparent window 4*a* through which the interior can be observed. Below the transparent window 4*a* is an opening 4*b* for insertion and removal of a paper receiving tray 40 described later.

A delivery way 6 provided at the paper feed port of the paper delivery apparatus is connected to a paper delivery port 2*a* of the printing machine 2. The delivery way 6 has a plurality of endless conveyor belts 7 which are driven by a conveyor motor M1. A printed sheet W printed by the printing machine 2 is carried on the endless belts 7 into the paper delivery apparatus 1. At the delivery way 6 is mounted a conveyor sensor to detect the printed sheet W during conveyance.

As shown in FIG. 2, there is provided a fan unit 8 above the delivery way 6. The fan unit 8 has a fan and a fan motor for driving this fan. The fan unit 8 blows at a specific pressure towards the delivery way 6, to thereby properly convey the printed sheet W ejected from the printing machine, in close contact with the endless belt 7 of the delivery way 6. In this case, there may be provided a suction means beneath the delivery way 6 in place of the fan unit 8 in order to firmly hold the printed sheet W on the surface of the endless belt 7 by sucking air from under the conveyor surface.

As shown in FIGS. 3 and 4, the frame of the paper delivery apparatus 1 is composed of a flat base plate 1*a* at the bottom section, vertical side plates 1*b* and 1*c* which intersect at right angles with the direction of entrance of the printed sheet W into the apparatus 1, and a plurality of supporting members 1*d* for supporting the side plates 1*b* and 1*c*.

As shown in FIG. 3, paper width adjusting shafts 9, 9 having reversely threaded portions 9*a* and 9*b* are supported horizontally and rotatably at two positions, upper and lower, on the outside surface side of the side plate 1*b* of the paper delivery apparatus 1. On the outside surface of the side plate 1*b* a pair of paper width adjusting plates 10, 10 are provided. The paper width adjusting plate 10 is a vertically long rectangular base plate, supporting one end of the rotating shaft of a primary holding means 23 and the rotating shaft of a secondary holding means 24 which will be described later. The paper width adjusting plate 10 is provided with nut sections 10*a* and 10*b* each having an internal thread section. Within these nut sections 10*a* and 10*b* the threaded portions 9*a* and 9*b* of the paper width adjusting shaft are threadedly engaged.

On the outside surface side of the side plate 1*c* opposite to the side plate 1*b*, as shown in FIG. 4, paper width adjusting shafts 11, 11 having reversely threaded portions 11*a* and 11*b* are horizontally and rotatably supported at two places, upper and lower. On the outside surface of the side plate 1*c* a pair of paper width adjusting plates 12, 12 are provided. The paper width adjusting plate 12 is a vertically long rectangular base plate, which supports the other end of the rotating shaft of the primary holding means 23 and the rotating shaft of the secondary holding means 24. The paper width adjusting plate 12 is provided with nut sections 12*a* and 12*b* each having an internal thread section. With these nut sections 12*a* and 12*b*, the threaded portions 11*a* and 11*b* of the paper width adjusting shaft are threadedly engaged.

As shown in FIG. 4, the four paper width adjusting shafts 9, 9, and 11, 11 are interconnected through a timing belt 13. A paper width adjusting motor M4 shown in FIG. 3 drives the timing belt 13 through a driving gear.

With the rotation of the paper width adjusting shafts 9, 9 and 11, 11 by the drive of the paper width adjusting motor M4, the paper width adjusting plates 10 and 12 move symmetrically in opposite directions in accordance with the direction and angle of rotation of these shafts, thereby enabling the adjustment of the distance between the primary holding means and the secondary holding means to the size of the printed sheet W (e.g., the size of a postcard or a double postal card).

The side plate 1*b* of the frame is provided, as shown in FIG. 3, with a width home sensor 15 which detects the home position of the paper width adjusting plate 10 and a width limit sensor 16 which detects a limit position. These sensors 15 and 16 serve to detect the detecting plate 10*c* mounted at the bottom section of the paper width adjusting plate 10.

In the upper part of the paper width adjusting plates 12, 12 is provided a cutout 12*c*. In this cutout 12*c*, parts of the restricting plates 6*a* on both sides of the delivery way 6 fit. The width position of the restricting plates 6*a* can be adjusted by changing the distance between the paper width adjusting plates 12, 12.

Between the paper width adjusting plates 10 and 12 are rotatably mounted rotating shafts 20, 21 and 22, one by one from above, as stated above. Each combination of the paper width adjusting plates 10 and 12 is installed on the right and left sides, in the direction of entrance of the printed sheet W, and therefore the rotating shafts 20, 21 and 22 are mounted in pairs on the right and left sides.

Figure 5A:
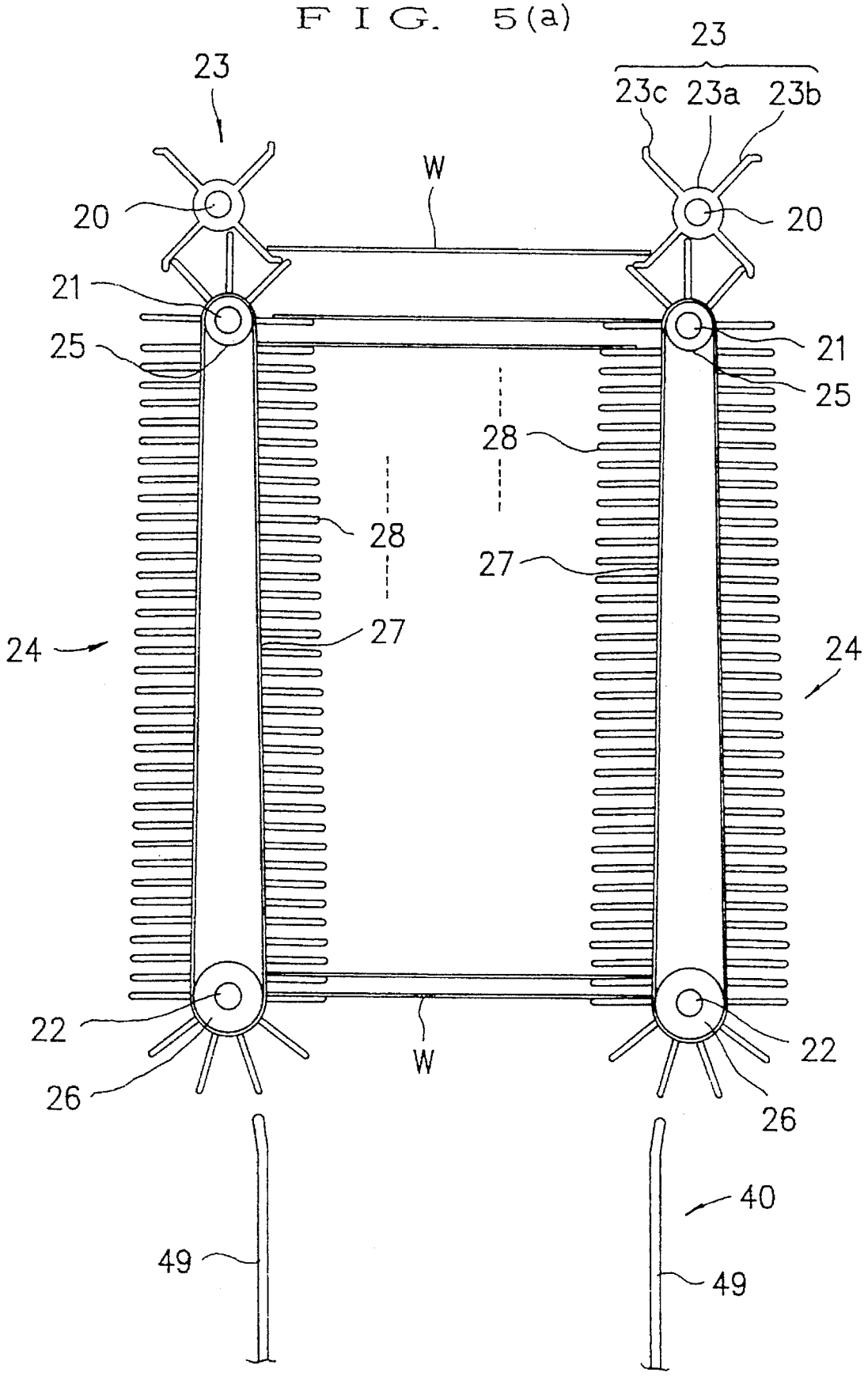
FIG. 5(*a*) is a view showing primary and secondary holding means of the paper delivery apparatus.
Figure 5B:
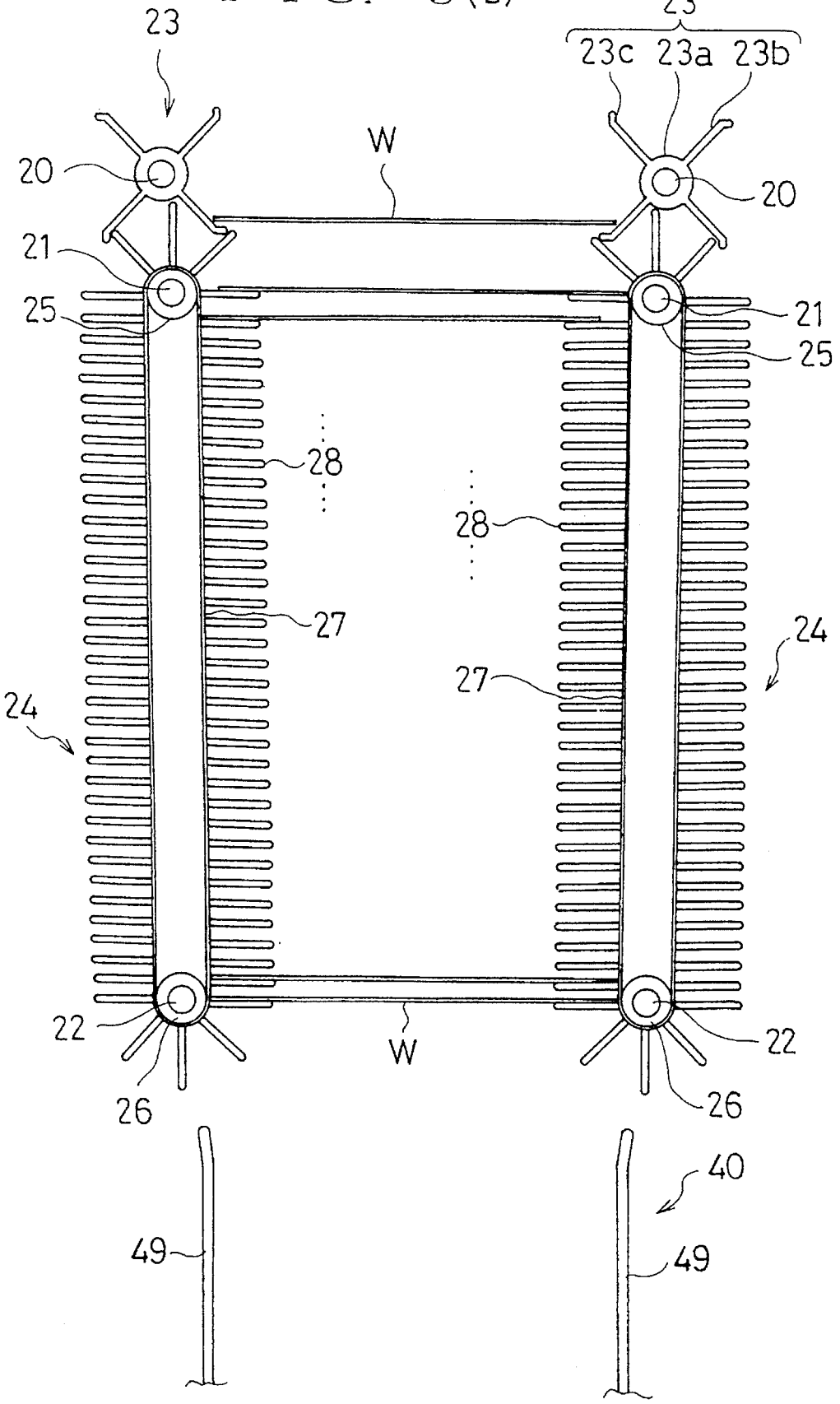

As shown in FIG. 3, the primary holding means 23 are mounted near both side edges of the printed sheet W ejected from the printing machine 2. Further, as shown in FIG. 5(*a*), the primary holding means 23 is of such a construction that flat plate-like paper receiving sections 23*b* are radially provided at intervals of 90 degrees on a cylindrical hub section 23*a*. On the forward end of each of the paper receiving sections 23*b*, there is formed an expanded portion 23*c* which is inclined by a specific angle to the rear in the direction of rotation.

As shown in FIGS. 3 to 5(*a*), four belt conveyor mechanisms are provided, two on both of the right and left sides, as the secondary holding means 24 beneath the primary holding means 23. Each secondary holding means 24 has an upper pulley 25 mounted on the rotating shaft 21, a lower pulley 26 mounted on the rotating shaft 22, and an endless belt 27 vertically mounted and wound around the upper and lower pulleys 25 and 26.

The belt 27 of the secondary holding means 24 is provided with rectangular tongue-like paper receiving sections 28 equally spaced in the direction of travel of the belt 27. Both side edges of the printed sheet W are held by the paper receiving sections 28 of the right and left secondary holding means 24. The primary drying of the printed sheet W is done while the paper is being carried downward with the drive of the belt 27.

The space between the paper receiving sections 28 is, as shown in FIG. 5, set at about 45 degrees in the angle of rotation on the circumference of the upper pulley 25. If this angle (space) is too small, it is impossible to properly deliver the printed sheet W from the primary holding means 23 to the paper receiving section 28. Contrarily, if this angle (space) is too large, the number of the paper receiving sections 28 per unit length must be decreased and therefore it becomes impossible to provide a time required for the primary drying unless the length of the belt 27 is increased or the printing speed of the printing machine 2 is slowed down.

In the secondary holding means 24 of the present embodiment, the lower pulley 26 is larger in diameter than the upper pulley 25 as shown in FIG. 5(*a*). However, the upper rotating shaft 21 and the lower rotating shaft 22 are mounted parallelly within the same perpendicular plane. And the distance between a pair of belts 27, 27 is set wider than the width of the printed sheet W at the upper part of the belt 27 for receiving the printed sheet W and the distance is approximately the same as the width of the printed sheet W at the lower part of the belt 27 for discharging the printed sheet W.

Therefore, as shown in FIG. 5(*a*), the printed sheet W supported on the right and left paper receiving sections 28, 28 in the upper part of the secondary holding means 24 differs in a traveling position in the direction of width because the distance between the right and left belts 27, 27 is considerably larger than the width of the printed sheet W. However, when the printed sheet W supported on the paper receiving sections 28 is moved downward by the belts 27, the distance between the pair of belts 27, 27 holding the printed sheet W gradually decreases, correcting the position of the printed sheet W held on the belts in the direction of width. Then, when the printed sheet W is released from the paper receiving sections 28 in the lower part of the belt 27 of the secondary holding means 24, the distance between the belts 27, 27 and the width of the printed sheet W agree on the whole. Therefore, the position where the printed sheet W goes off and down from the belts 27 is fixed in the direction of width of the printed sheet W. Consequently the printed sheet W thus falling is properly stacked in the paper receiving tray 40, which will be described later, below the secondary holding means 24.

On the end portion of the rotating shaft 21 protruding from the side plate 1*b* are mounted a gear 29 and a worm wheel 30 as shown in FIG. 3. Also on the end portion of the rotating shaft 20 protruding from the side plate 1*b* is mounted a gear 31. The gear 29 on the rotating shaft 21 and the gear 31 on the rotating shaft 20 are connected through an intermediate gear 32.

On the side plate 2*b*, as shown in FIG. 3, a worm shaft 33 having worm gears 33*a*. 33*a* is rotatably mounted. The worm gears 33*a*, 33*a* are in mesh with the worm wheels 30, 30 on the rotating shafts 21, 21. As shown in FIGS. 3 and 4, the worm shaft 33 is driven by a down motor M2 through a timing belt 34. With the driving of the down motor M2, the left-hand rotating shaft 21 in FIG. 3 rotates clockwise while the right-hand rotating shaft 21 simultaneously rotates counterclockwise.

Here, the rotating shaft 21 and the rotating shaft 20 are connected via the gears 29, 31 and 32. The rotating shaft 21 and the rotating shaft 20 are set at the angular velocity ratio of 1:2, so that the rotating shaft 20 rotates twice per rotation of the rotating shaft 21. The driving means of the primary holding means 23 and the secondary holding means 24 is composed of these rotating shafts 20 and 21, gears 30, 31 and 32, and the down motor M2.

Their gear ratio may be set at 1:3 with the space between the paper receiving sections 23*b* set at 90 degrees and with the space between the paper receiving sections 28 set at 30 degrees in terms of the angle of rotation on the circumference of the pulleys 25 and 26, that is, one-third of the above-described angle of 90 degrees. Other kinds of settings may be made by changing the space (angle) of the paper receiving section 28 in relation to the angular velocity ratio.

On the side plate 1*b* of the frame a down sensor 35 is provided as shown in FIG. 3. The down sensor 35 functions to detect the amount of angle of rotation of the rotating shaft 20 by detecting a slit of a rotating disk provided on the end of the rotating shaft 20. The angle of rotation of the rotating shaft 20 represents the amount of movement or the amount of descent of the secondary holding means 24.

The secondary holding means 24 of the present embodiment described above is provided with four belts 27 in all, upper and lower, installed at four corner sections of the printed sheet W; it is to be noticed, however, that one belt having sufficient length in the lengthwise direction of the printed sheet W may be installed between the upper and lower rotating shafts 21 and 22, so that both side edges of the printed sheet W may be supported by a pair of right and left belts.

In the secondary holding means 24 of the present embodiment, the lower pulley 26 is larger in diameter than the upper pulley 25. However, the lower pulley 26 and the upper pulley 25 may have the same diameter (FIG. 5(*b*)), and the distance between the pair of belts 27, 27 corresponding to the right and left side edges of the printed sheet W may be made wider than the width of the printed sheet W at the upper part of the belt 27 which receives the printed sheet W and approximately the same as the width of the printed sheet W at the lower part of the belt 27 which discharges the printed sheet W.

Next, the paper receiving tray 40 as the paper stacker apparatus which holds ejected printed sheets will be explained. As shown in FIG. 3, about the upper half part of the paper delivery apparatus 1 is provided with the primary holding means 23 and the secondary holding means 24 as described above. Also as shown in FIGS. 2 and 3, the lower part of the paper delivery apparatus 1 forms a part for stacking printed sheets W; the paper receiving tray 40 for holding the printed sheets W is horizontally removably arranged. Each of the printed sheets W ejected from the printing machine 2 is separately held for a specific time the secondary holding means 24 and, after drying of the ink, falls to be stacked in the paper receiving tray 40.

Figure 6:
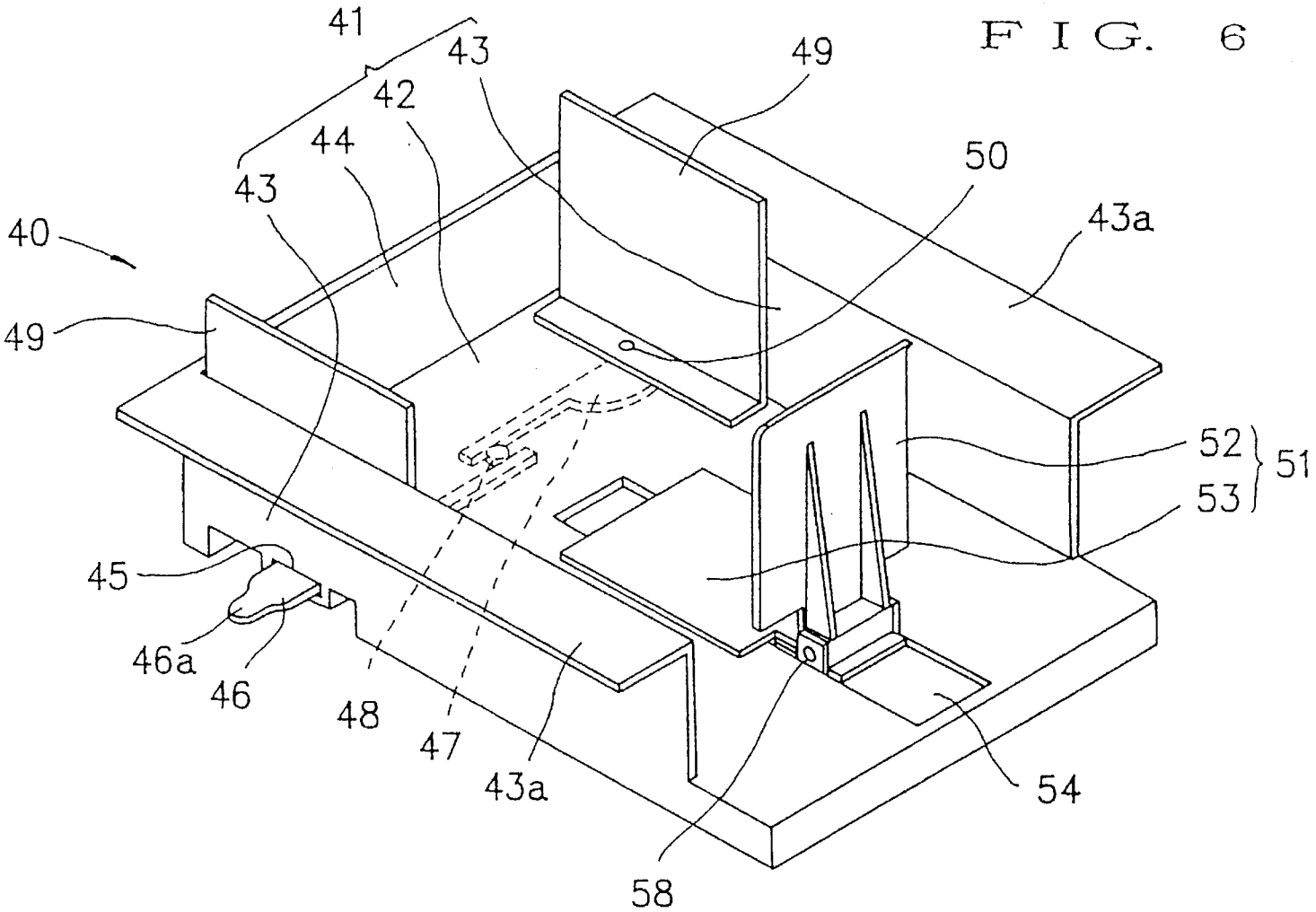
FIG. 6 is a perspective view showing a paper receiving tray of the paper delivery apparatus.

As shown in FIG. 6, the paper receiving tray 40 has a box section 41 as a base body. The box section 41 has a bottom wall 42, right and left side walls 43, 43, and a rear wall 44, and is open on the top and front face sides. The side wall 43 is provided with a flange 43*a* for convenience of handling, so that the paper receiving tray 40 can easily be inserted into, and taken out of, the lower part of the paper delivery apparatus 1 by grasping the flanges 43*a* by hand.

In the bottom wall 42 of the box section 41 is formed a guide groove 45 extending laterally. In this guide groove 45 are inserted a pair of slender plate-like fence width adjusting plates 46 and 47. One outer end portion of the fence width adjusting plate 46 protrudes from the opening of the guide groove 45 as an operating knob 46*a* to the side wall 43 side of the box section 41. At the center of the bottom surface of the bottom wall 42 near the rear wall 44 a pinion 48 is axially rotatably supported. On the other inner end portion of the fence width adjusting plates 46 and 47 is formed a rack, which is engaged with the pinion 48.

On the bottom wall 42 there are installed a pair of side fences 49, 49 which guide both side edges of the printed sheet W, in parallel with the right and left side walls 43, 43. The side fences 49 are connected to the fence width adjusting plates 46 and 47 with a pin 50. The pin 50 is inserted into a guide groove not illustrated provided in the bottom wall 42 along the lateral direction.

In the above-described constitution, when the knob 46*a* of the fence width adjusting plate 46 is grasped and moved in and out in the lateral direction, the fence width adjusting plate 46 and the other fence width adjusting plate 47 are connected through the pinion 48, moving in opposite directions. Therefore, since the pair of side fences 49, 49 connected to these fence width adjusting plates 46, 47 move toward, and away from, each other along the lateral direction, thus arbitrarily enabling the setting of a space between the two side fences 49, 49 in accordance with the width of the printed sheet W to be stacked.

On the bottom wall 42 of the box section 41 is mounted one front fence 51. The front fence 51 has a fence plate 52 for guiding the front edge of the printed sheet W and a bottom plate 53 which is in contact with at least a part of the back surface of the printed sheet W to be stacked in the box section 41. The fence plate 52 and the bottom plate 53 are integrally constituted, meeting at right angles with each other. In the using condition shown in FIG. 6, the fence plate 52 is in parallel with the rear wall 44, and the bottom plate 53 is in contact with the bottom wall 42 of the box section 41.

The front fence 51 is mounted in relation to the box section 41 so as to move straight in a direction parallel with the surface of the side fences 49, 49 and also to rotate within a plane parallel with the surface of the side fences 49, 49.

Figure 7:
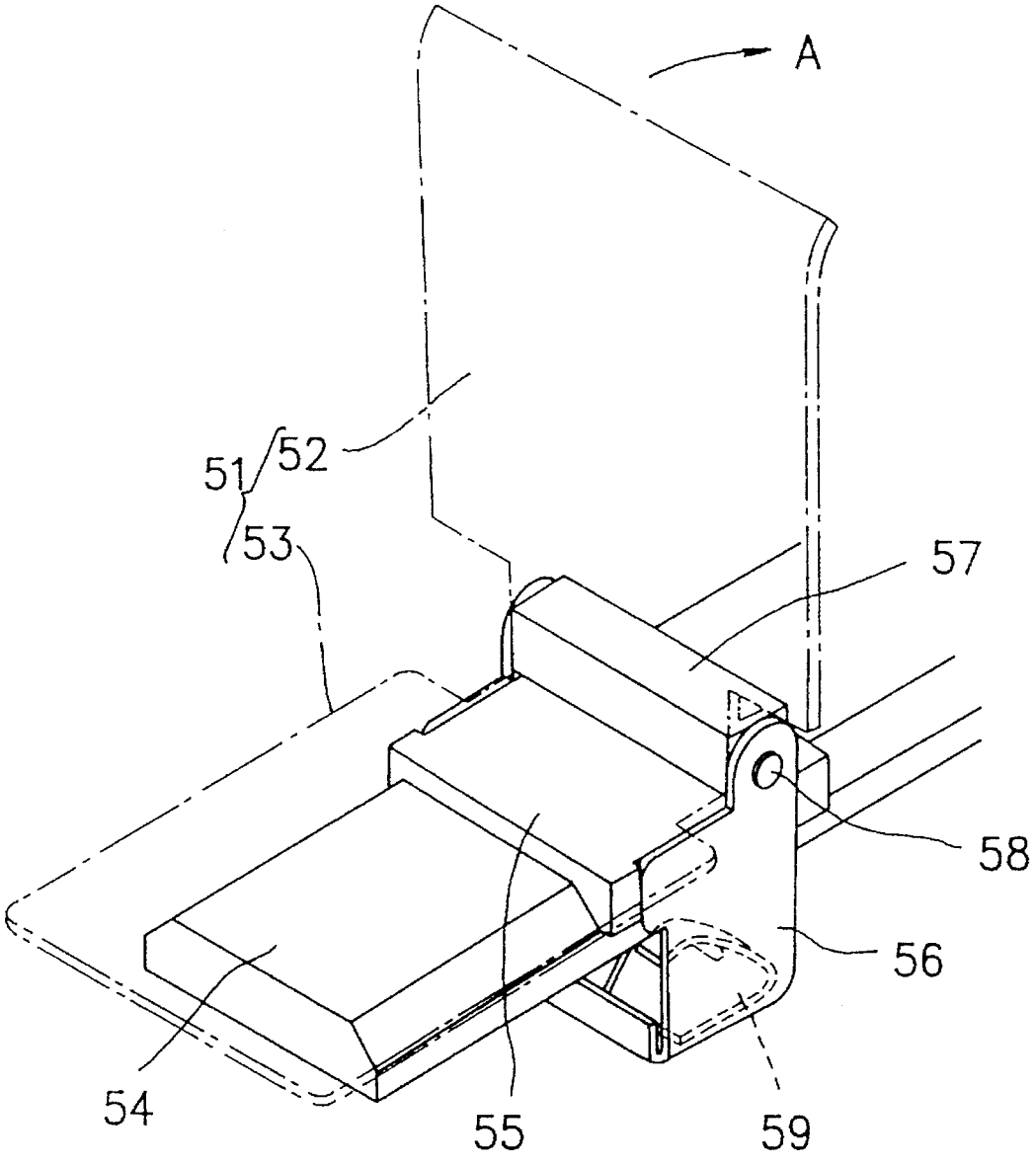
FIG. 7 is a perspective view showing a part of the paper receiving tray of the paper delivery apparatus.

The front fence 51 is longitudinally movable along a rail 54 installed on the bottom wall 42. As shown in FIG. 7, a slider 55 is slidably mounted on the rail 54. The slider 55 is fitted with an approximately U-shaped attaching metal 56. The slider 55 and the attaching metal 56 can move together in the longitudinal direction of the rail 54, and also can move relatively in a vertical direction. At the top end section of the attaching metal 56 a square column 57 is rotatably installed through a shaft 58, while at the bottom end section of the attaching metal 56 is mounted a plate spring 59, which presses the lower surface of the rail 56 from below. Therefore the slider 55 is constantly pressed by the force of a plate spring 59 against the upper surface of the rail 54.

Figure 8:
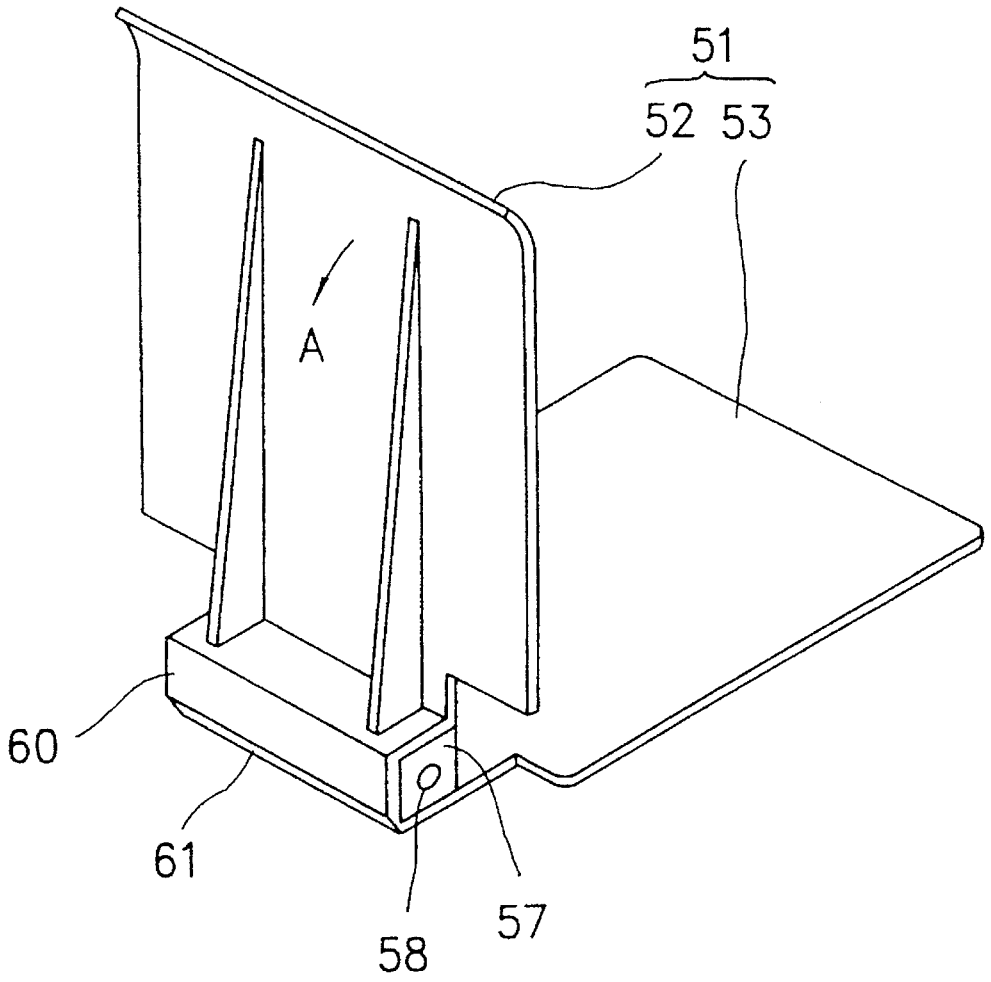
FIG. 8 is a perspective view showing a part of the paper receiving tray of the paper delivery apparatus.

As shown in FIGS. 7 and 8, an approximately square groove-like fixed section 60 is provided between the fence plate 52 of the front fence 51 and the bottom plate 53. The fixed section 60 is secured to a square column 57 of the attaching metal 56. At the lower corner of the fixed section 60 is formed a nearly 45-degree chamfered portion 61 with respect to the flat surface of the bottom plate 53.

According to the constitution of the holding means of the front fence 51 stated above relative to the box section 41, that is, the mechanism comprising the rail 54, the slider 55, the attaching metal 56 and the plate spring 59, the front fence 51 can longitudinally move along the rail 54, and therefore can be set in a position where it agrees with the longitudinal size of the printed sheet to be stacked in the paper receiving tray 40. Also as indicated by the arrow A in FIGS. 7 and 8, it is possible to set the front fence 51 in a still and steady state with the chamfered portion in contact with the upper surface of the slider 55 by turning the fence plate 52 of the front fence 51 forward on the center of the shaft 58.

This operation will then be explained with reference to FIGS. 9(*a*) and 9(*b*). From the state shown in FIG. 9(*a*), the fence plate 52 is turned counterclockwise in the drawing on the center of the shaft 58 as shown in FIG. 9(*b*). Since the rail 54 is fixedly installed, the slider 55 mounted on the rail 54 also can not move vertically. Therefore, when the chamber portion 61 of the front fence 51 presses the slider 55, the leaf spring 59 is compressed to allow the upward movement of the attaching metal 56. Then, the front fence 51 comes to be steady with the chamfered portion 61 held in contact with the slider 55 by the restoring force of the leaf spring 59 thus compressed. By thus tilting the front fence 51, a stack of printed sheets W on the bottom plate 53 of the front fence 51 can be held 45 degrees upward and can easily be taken out.

In the paper receiving tray 40 of the paper delivery apparatus according to the present embodiment it is possible to set within the paper receiving tray 40 a paper receiving range adjusted to the dimensions and external shape of the printed sheet W being ejected, by means of a pair of side fences 49, 49 the distance of which is easily adjustable and the front fence 51 the longitudinal position of which is also easily adjustable. The printed sheet W thus received in the paper receiving tray 40 is hard to move in the paper receiving tray 40 and therefore its printed surface will not be rubbed and smeared.

It will probably be supposed to be hard to take out a large number of printed sheets W from the paper receiving range within the fence that has been set to the dimensions and external shape of the printed sheet W; in the case of the paper receiving tray 40 of the present embodiment, however, since the distance between the pair of side fences 49, 49 can easily be widened by moving the fence width adjusting plate 46 and furthermore the front fence 51 can easily be inclined by one hand, the stack of the printed sheets W can be smoothly taken out of the paper receiving tray 40.

In a major position of the frame is provided a tray detecting switch not illustrated, for detecting the presence of the paper receiving tray 40.

Figure 10:
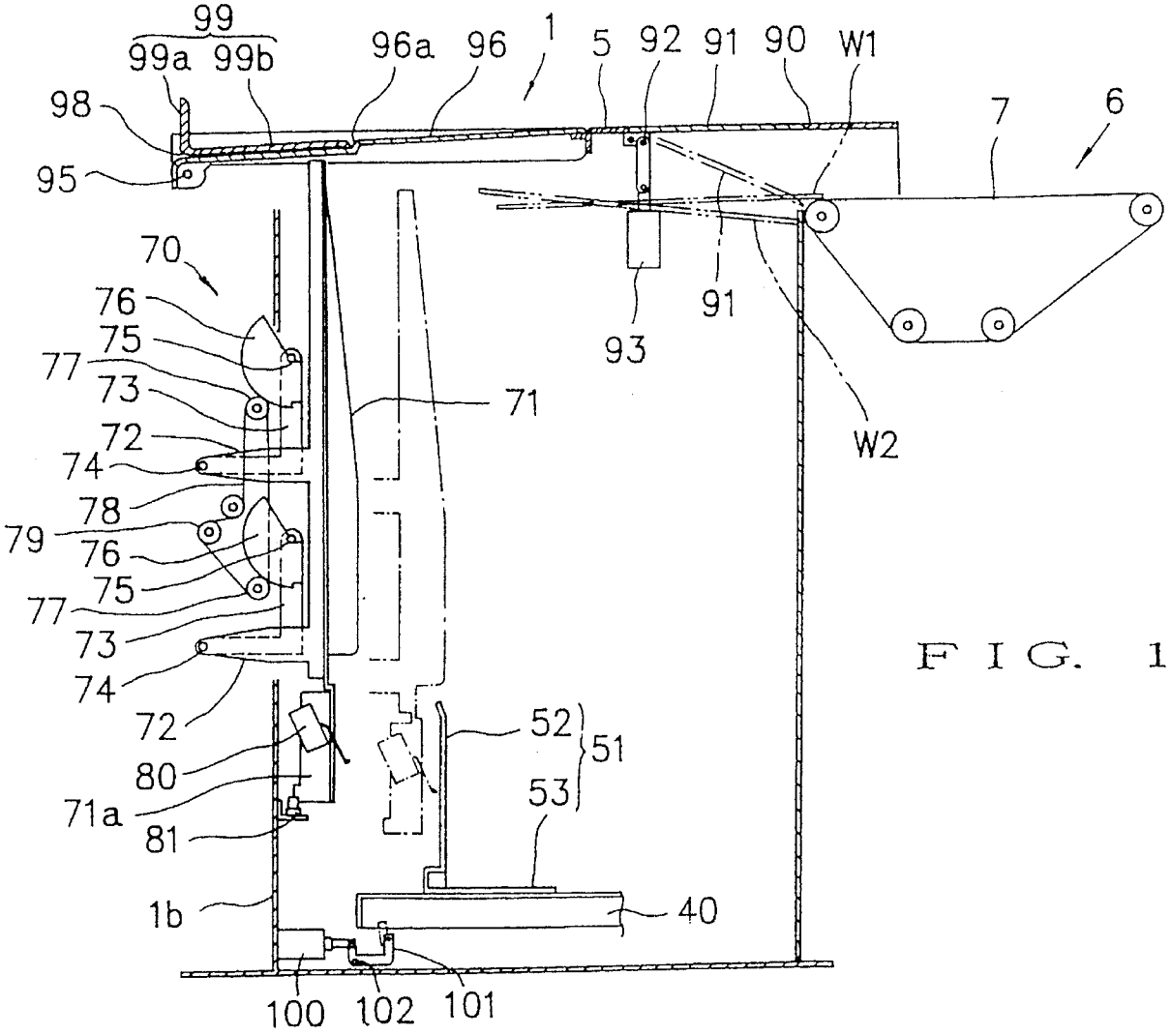
FIG. 10 is a sectional view, partly omitted, of the paper delivery apparatus.

On the side plate 1*b* of the frame of the paper delivery apparatus 1 is mounted a paper stopper device 70 as shown in FIGS. 3, 4 and 10. The paper stopper device 70 has a vertically long and narrow rectangular paper stopper or jogging plate 71. The lower half of the paper stopper plate 71 is parallel to the vertical plane, while the upper half has a surface slightly upwardly inclined from the vertical plane in relation to the direction of entrance of the printed sheet W. The printed sheet W that has been delivered on the endless belt 7 into this apparatus 1 stops at the jogging plate 71 where the leading end of the printed sheet W is restricted, and then rides on the primary holding means 23.

The inclined upper half of the jogging plate 71 serves to prevent the rear part of the printed sheet W from riding on the side plate on the endless belt 7 side like a printed sheet W1 shown in FIG. 10 when the printed sheet W coming on the endless belt 7 of the delivery way 6 hits against, and bounces back from, the jogging plate 71.

In the present embodiment, since the upper half of the jogging plate 71 is inclined as described above, the printed sheet W that has hit against, and bounced back from, the jogging plate 71 tends to tilt downward at the rear part like a printed sheet W2 shown in FIG. 10. Like the principle that a ball hitting against a wall bounces back at the same angle of reflection as the angle of incidence, when the printed sheet W has horizontally hit against the inclined jogging plate 71, the leading end of the printed sheet W faces slightly upward and therefore the rear part of the printed sheet W tilts down, thereby preventing the printed sheet W from riding over to the delivery way 6.

On the back side of the jogging plate 71 are provided a pair of right and left arms 72, in two sets, upper and lower. To the forward end of the arm 72 of each set one end portion of an L-shaped link 73 is rotatably connected through a shaft 74. The other end portion of the link 73 is rotatably connected to the side plate 1*b* side of the frame through a shaft 75.

On each of the upper and lower links 73 is fixedly mounted a sector gear 76. Each of the sector gears 76 is in mesh with a gear 77. The gear 77 is connected to the driving gear 79 through a timing belt 78. The driving gear 79 is driven by a jogging driving motor M3 mounted on the side plate 1*b* of the frame.

In the lower part of the jogging plate 71 a jogging switch 80 is provided. The jogging device 70 moves forward until the jogging switch 80 contacts the fence plate 52 of the front fence 51 provided on the paper receiving tray 40, then stopping the operation of the jogging motor M3.

As shown in FIG. 4 to 10, there is provided a jogging home sensor 81 in a specific position inside the side plate 1*b* of the frame. When the jogging plate 71 has retreated to the home position, the detecting plate 71*a* provided at the bottom of the jogging plate 71 operates the jogging home sensor 81, and the jogging motor M3 will be stopped in accordance with the output signal of the jogging home sensor 81.

In the above-described constitution, when the jogging motor M3 is operated, the sector gear 76 turns to rock the link 73 and accordingly the jogging plate 71 in connection with the link 73 can move as far as the position indicated by an imaginary line in FIG. 10. The front fence of the paper receiving tray 40 can be set in various positions in accordance with the size of the printed sheet W to be stacked; according to this jogging device 70, the position of the front fence 51 is detected by the jogging switch 80 and is automatically stopped. It is, therefore, possible to always accurately set the jogging plate 71 at the front end section of the paper receiving range set within the paper receiving tray 40.

The printed sheet W that has come from the delivery way 6 hits on the jogging plate 71 inclined upward in relation to the direction of travel, to be thereby prevented from bouncing back to ride on the delivery way 6 and to move into the primary holding means 23 with its lengthwise position restricted to a specific position.

As shown in FIGS. 2 to 10, in the upper surface of the cover section 5 of the casing 3 which covers the frame of the paper delivery apparatus 1 a discharge hole 90 is formed for discharging the incoming printed sheet W out of the apparatus. At the forward edge of the discharge hole 90 in the direction of entrance of the printed sheet W, a flap 91 is turnably mounted on a shaft 92. The flap 91 and the discharge hole 90 have an identical form. A torsion coil spring not illustrated which is interposed on the shaft 92 of the flap 91 presses the flap 91 upward to close the discharge hole 90.

To one end of the shaft 92 of the flap 91 is connected a flap solenoid 93 as a driving means. As the magnetic core of the flap solenoid 93 moves in, the shaft 92 is turned against the force of the coil spring until the forward end of the flap 91 contacts the bottom of the delivery path 6, thus opening the discharge hole 90. In this state, the printed sheet W coming from the delivery way 6 is guided to the flap 91, being discharged out of the apparatus 1 at the discharge hole 90.

Generally, in the printing machine 2, a trial printing is done before entering into normal printing. Trial printed sheets W or first prints in normal printing are discarded and are not used as normal printed sheets W. Such unnecessary printed sheets W can be discharged out of the paper delivery apparatus by changing over the route of travel between trial printed sheets or first prints and normal printed sheets W by means of the flap 91 of the apparatus.

As shown in FIGS. 2 to 10, a cover 96 which can be opened and closed on the center of a shaft 95, is provided on the upper surface of the casing 3 which encloses the frame of the paper delivery apparatus 1. With the cover 96 opened, the interior of the apparatus can be seen. On the cover 96 side is fitted a cover opening-closing switch 97, which outputs a signal for closing or opening the cover 96.

As shown in FIGS. 2 to 10, the aforesaid cover 96 is inclined to the rear from the flap 91, and at the rear end section is provided a recess 96*a*. In this recess 96*a* is mounted a stopper 99 which is turnable on a shaft 98. The stopper 99 functions to stop the printed sheet W ejected via the flap 91, on the cover 96, whereby the printed sheet W can be prevented from jumping over the apparatus and scattering. The stopper 99 comprises two plate sections of different lengths which meet at right angles. In the state shown in FIG. 10, a low plate section 99*a* is erected, while in FIG. 2 a high plate section 99*b* is erected. Which plate section should be erected is selected according to the thickness and quality of the printed sheet W ejected by the flap 91.

As shown in FIG. 10, on the side plate 1*b* of the frame is mounted a tray lock solenoid 100. A link 101 is so supported as to be rotated by the shaft 102. The movable part of the tray lock solenoid 100 and the link 101 are connected by a pin. When the tray lock solenoid 100 is operated to withdraw the magnetic core, the link 101 rotates counterclockwise in FIG. 10 on the center of a shaft 102 until the forward end of the link 101 goes into the route for mounting and removing the paper receiving tray 40 with respect to the apparatus. Thus the paper receiving tray 40 is fixed and accordingly can not be taken out of the apparatus 1.

The paper delivery apparatus 1 has a drying means including a blowing means and a heating means for forced drying of ink on the printed sheet W. The drying means adjusts the atmospheric condition within the casing 3, assisting in ink drying of the printed sheet W which is held therein. The drying means is operated on and off by means of a drying switch.

Figure 11:
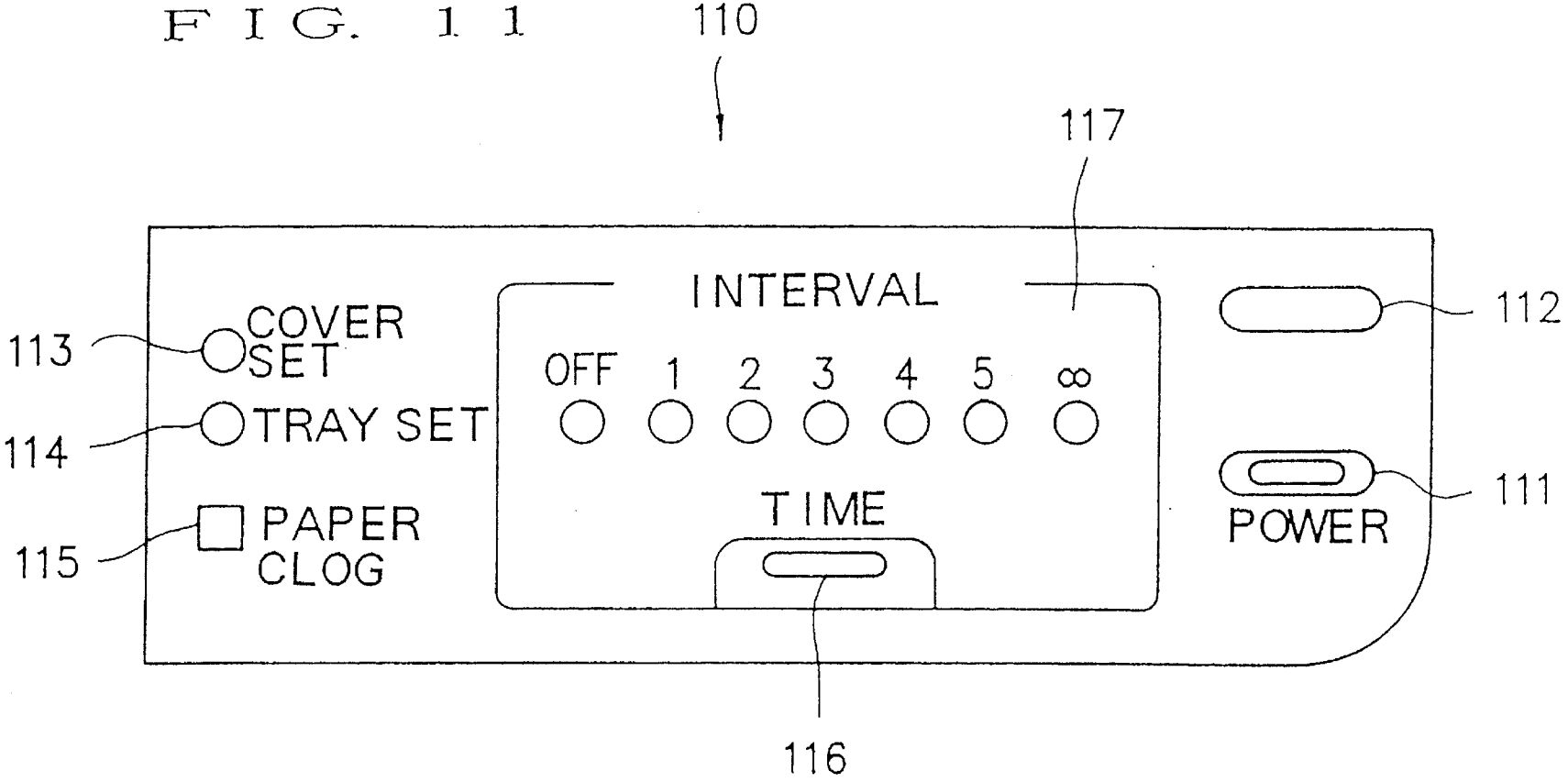
FIG. 11 is a front view showing the operation/display panel of the paper delivery apparatus.

FIG. 11 shows an operation display panel 110 provided on the cover section 5 of the casing 3 of the paper delivery apparatus 1. A reference numeral 111 denotes a power pushbutton switch, and LED 112 denotes a pilot lamp which indicates the condition of the power source. A cover set LED 113 indicates the opened-closed state of the cover 96 which is openable. A tray set LED114 indicates the presence of the paper receiving tray 40. A paper jam LED115 indicates the presence of paper jamming with the operation of the pushbutton switch 116, the time to hold and dry the printed sheet is switched and information displayed on the interval display section 117 comprising a plurality of LED's are shifted in succession.

Figure 12:
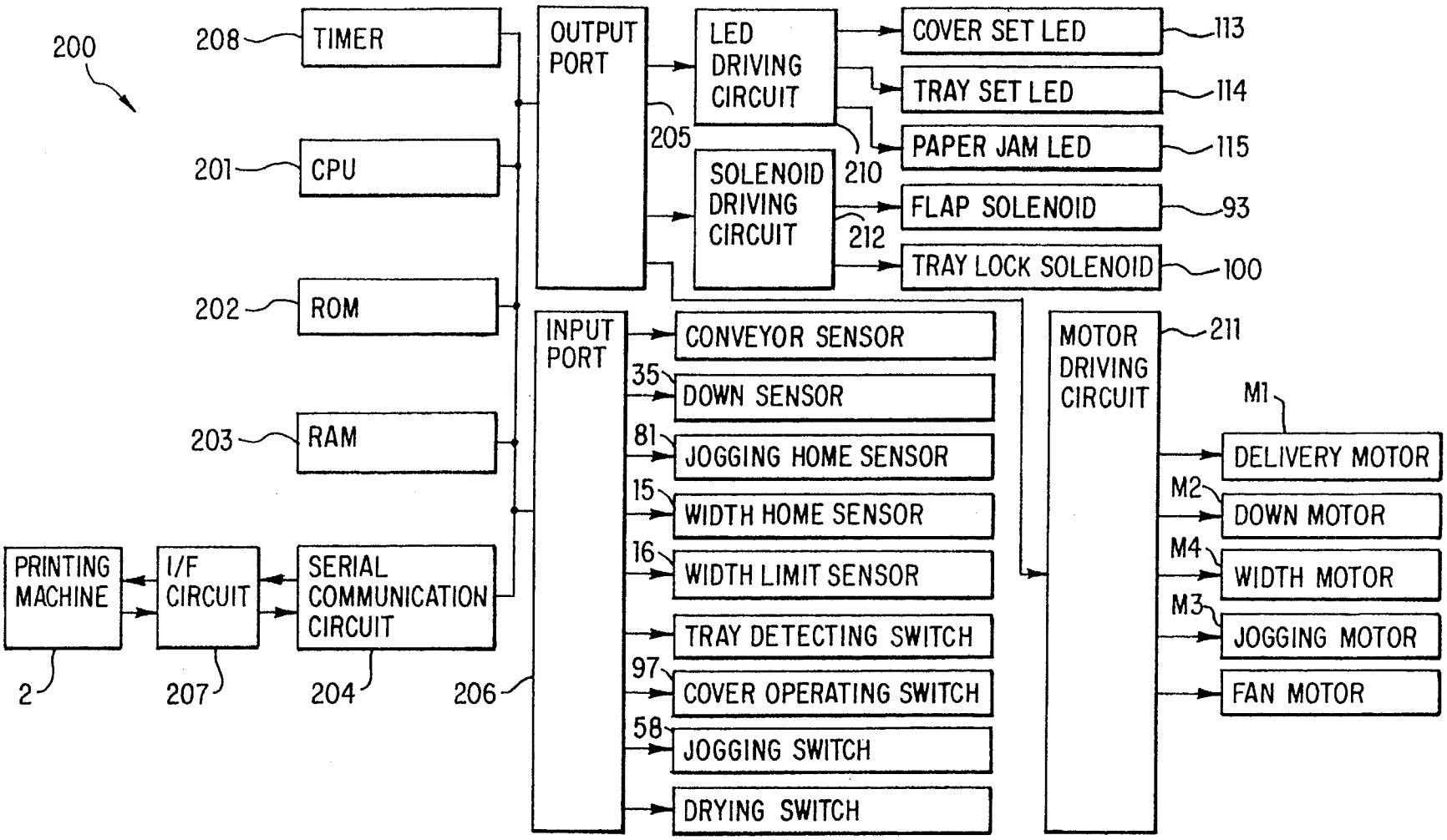
FIG. 12 is a block diagram of a control circuit of the paper delivery apparatus.
Figure 13:
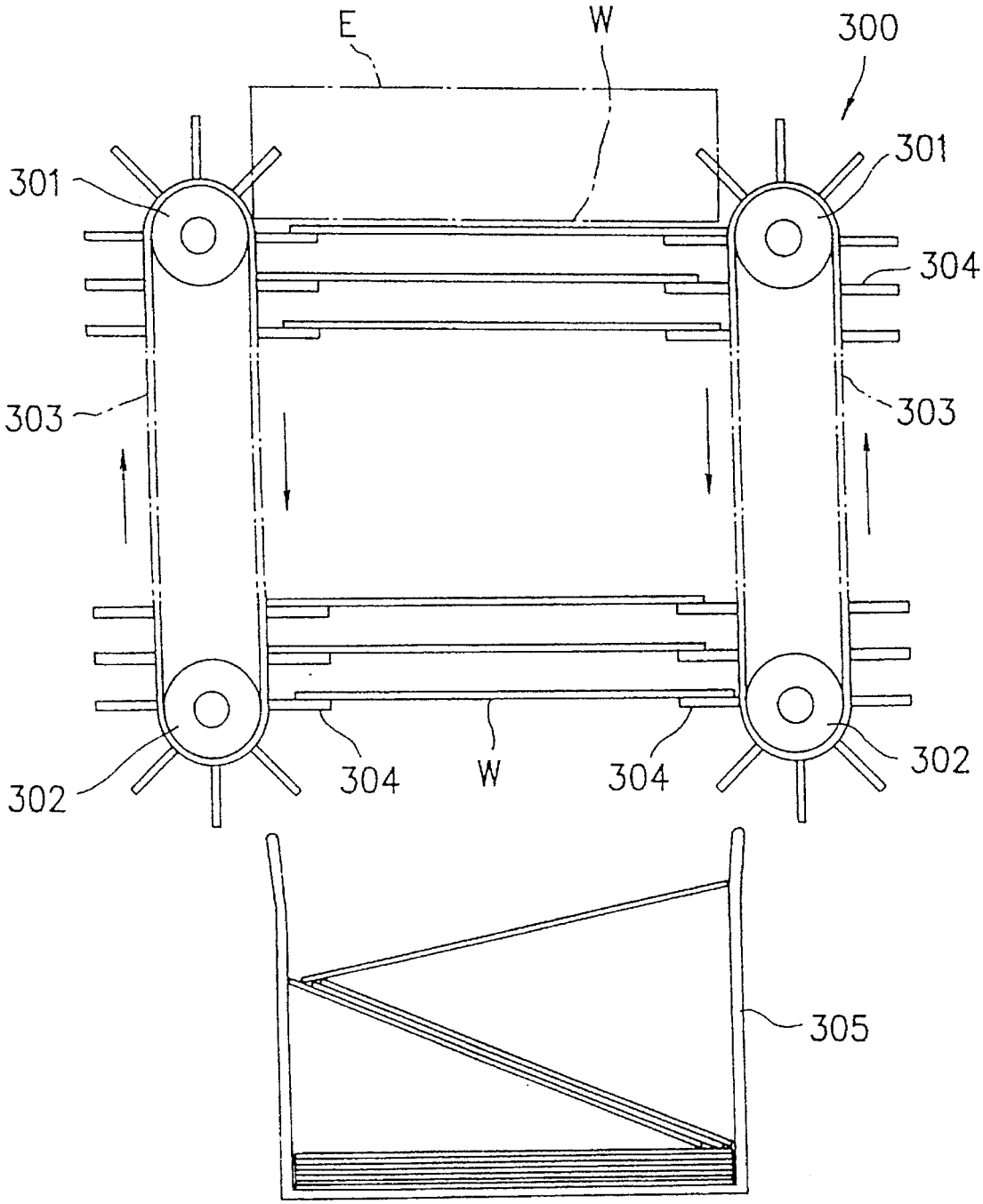
FIG. 13 Prior Art
FIG. 13 is a view showing a paper delivery apparatus presented as a comparative example proposed by the present applicant.

Next, FIG. 12 is a block diagram showing a control means of the paper delivery apparatus 1. The control means 200 consists of a one-chip microcomputer having CPU201, ROM202, RAM203, serial communication circuit 204, output port 205 and input port 206. The serial communication circuit 204 is connected to the I/F section of the printing machine 2 through the I/F circuit 207.

The control means 200 is supplied with a detection signal from each sensor and switch mounted on the apparatus and with a clock signal from a timer 208. The control means 200 controls the display of the cover set LED 113, tray set LED 114, and paper jam LED 115 via the LED driving circuit 210. Also the control means 200 controls the driving of each motor via a motor driving circuit 211. Further the control means 200 controls the driving of each solenoid via a solenoid driving circuit 212. This control means 200 performs the paper delivery control of the paper delivery apparatus 1.

According to the paper delivery apparatus 1 of the present embodiment heretofore explained, the printed sheets W can be received and held in succession in the paper receiving section 28 of the secondary holding means 24 which is driven downward at the same speed as the printing machine 2. With the paper delivery apparatus 1 so set that the ink on the printed sheets W being held and carried by the secondary holding means 24 will be dried within the specific period of time, the printed sheets W can be automatically dropped and discharged quickly into the paper receiving tray 40 at the time of completion of printing operation. Since there will occur no setoff, it is possible to improve printing quality. Moreover, printing operation is accomplished without manual handling of printed sheets W. Preparations for subsequent printing can be performed immediately after printing, thereby enabling to enhance the operation efficiency of the printing machine 2 and to improve printing operation efficiency.

Particularly, according to the paper delivery apparatus 1 of the present embodiment, the distance between a pair of belts 27, 27 of the secondary holding means 24 corresponding to both side edges of the printed sheet W gradually decreases with the downward movement of the printed sheet W. Therefore the position in the direction of width of the printed sheet W being carried downward is adjusted, so that the printed sheet W can be released downward at a specific position in the direction of width. Consequently, the printed sheet can be exactly received in the paper receiving tray 40 if the width of the paper receiving tray 40 has been adjusted to the width of the printed sheet W.

Furthermore, according to the paper delivery apparatus 1 of the present embodiment, the paper receiving tray 40 functions well. That is, the paper receiving tray 40 of the paper delivery apparatus 1 of the present embodiment is of such a design that the paper receiving range adjusted to the dimensions and external shape of the ejected printed sheet W can be set within the paper receiving tray 40 by a pair of side fences 49, 49 whose distance is adjustable, and the front fence 51 whose longitudinal position is also adjustable. Therefore, the printed sheet W that has been received in the paper receiving tray 40 will not move in the paper receiving tray 40 and consequently the printed side will not be rubbed to be smeared.

Furthermore, in the case of a prior art paper receiving tray, it is difficult to take out a number of printed sheets W from inside the fence adjusted to the dimensions and external shape of the printed sheet W. In the paper receiving tray 40 of the present embodiment, the front fence 51 can easily be inclined by a single hand, and therefore a stack of printed sheets W can easily be taken out of the paper receiving tray 40.

In the present embodiment explained above, the holding means for conveying the printed sheets comprises a rotating member including a belt wound around the upper and lower pulleys and a paper receiving section comprising a plurality of flaps fitted on the rotating member. However, it should be noticed that the holding means in the present invention is not limited to the holding means consisting of such a belt conveying mechanism and may be a holding means of such a construction that the paper receiving section is provided on the rotating body which is rotated by a driving means.

According to the paper delivery apparatus of the printing machine of the present invention, the space between the paper receiving sections of the holding means becomes narrower in the lower part of the rotating member for discharging the printed sheets than in the upper part of the rotating member for receiving the printed sheets. Thus the printed sheets being conveyed downward are properly positioned in the direction of width, being released downward in a specific position in the direction of width. Consequently, it is possible to stack the printed sheets exactly in the paper receiving tray in proper position in the direction of width even if the width of the paper receiving tray is not accurately set to the width of the printed sheets.

What is claimed is:

1. A paper delivery apparatus for delivering printed sheets printed in a printing machine, comprising:

holding means including at least two rotating members situated near the printing machine, each rotating member having an outer surface, said rotating members being disposed to face to each other such that a distance between the outer surfaces of the rotating members facing to each other at an upper portion for receiving the printed sheets is greater than a distance between the outer surfaces at a lower portion for discharging the printed sheets, said distance at the lower portion being at least equal to a length between side edges of each of the printed sheets to thereby align the sheets while moving the sheets from the upper portion to the lower portion; and paper receiving sections formed on the outer surfaces of the rotating members to project outward therefrom for holding bottom portions of said printed sheets ejected from said printing machine, driving means connected to the rotating members, said driving means rotating said rotating members to move said printed sheets held on said paper receiving sections downwardly, and a paper stacking section disposed beneath said rotating members for holding said printed sheets which have been released from said paper receiving sections.

2. A paper delivery apparatus according to claim 1, wherein said rotating member is a belt wound around upper and lower pulleys, and said paper receiving section comprises a plurality of flaps equally spaced in the direction of travel of said belt.

3. A paper delivery apparatus according to claim 2, wherein said lower pulley is larger in diameter than said upper pulley.

4. A paper delivery apparatus according to claim 2, wherein said lower pulley and said upper pulley have the same diameter.

5. A paper delivery apparatus according to claim 1, further comprising adjusting means connected to the rotating members, said adjusting means adjusting the distance between the rotating members.

6. A paper delivery apparatus according to claim 5, wherein said rotating member is an endless belt; said holding means includes at least two pairs of upper and lower pulleys, at least two pairs of upper and lower pulley shafts for holding the upper and lower pulleys, and at least a pair of adjusting plates, each adjusting plate holding each pair of the upper and lower pulley shafts; and said adjusting means includes an adjusting shaft engaging the adjusting plates for moving the adjusting plates in opposite directions when the adjusting shaft is driven so that a distance between the pulley shafts changes.

7. A paper delivery apparatus according to claim 1, wherein said distance between the outer surfaces at the lower portion is substantially same as the length between the side edges of each of the printed sheets.

8. A paper delivery apparatus according to claim 1, further comprising two primary holding means situated above the rotating members, said primary holding means including blades for receiving the printed sheets from the printing machine and delivering the printed sheets to the paper receiving sections.

* * * * *